United States Patent [19]

Hofmann

[11] Patent Number: 4,530,125

[45] Date of Patent: Jul. 23, 1985

[54] SWIMMING POOL CLEANER COMPONENT

[75] Inventor: Helmut J. Hofmann, Pompano Beach, Fla.

[73] Assignee: Selero Limited, Braamfontein, South Africa

[21] Appl. No.: 605,953

[22] Filed: May 1, 1984

[51] Int. Cl.[3] ..... E04H 3/20

[52] U.S. Cl. ..... 15/1.7; 15/246

[58] Field of Search ..... 15/1.7, 104.05, 104.06 R, 15/104.06 A, 211, 245, 246, 104.16, 257 R, 257 A; 68/122, 215; 366/332, 316, 347; 277/197, 215; 411/512

[56] References Cited

U.S. PATENT DOCUMENTS

| | | | |
|---|---|---|---|
| 2,339,187 | 1/1944 | Pain | 411/512 |
| 2,527,748 | 10/1950 | Linnit et al. | 15/211 |
| 3,619,844 | 11/1971 | Collins et al. | 15/104.06 R |
| 3,939,519 | 2/1976 | Muirhead | 15/104.06 R |
| 4,133,068 | 1/1979 | Hofmann | 15/1.7 |

FOREIGN PATENT DOCUMENTS

| | | | |
|---|---|---|---|
| 2034431 | 6/1980 | United Kingdom | 15/104.16 |

*Primary Examiner*—Edward L. Roberts

*Attorney, Agent, or Firm*—Sughrue, Mion, Zinn, Macpeak and Seas

[57] ABSTRACT

A pressure pad disc for use around the inlet of vacuum suction swimming pool cleaners as described in U.S. Pat. Nos. 4,023,227 and 4,208,752. The disc has radial slots 3 extending from the edge of the disc across the majority of the radius to define separate segments to which independently of the remainder of the disc.

4 Claims, 1 Drawing Figure

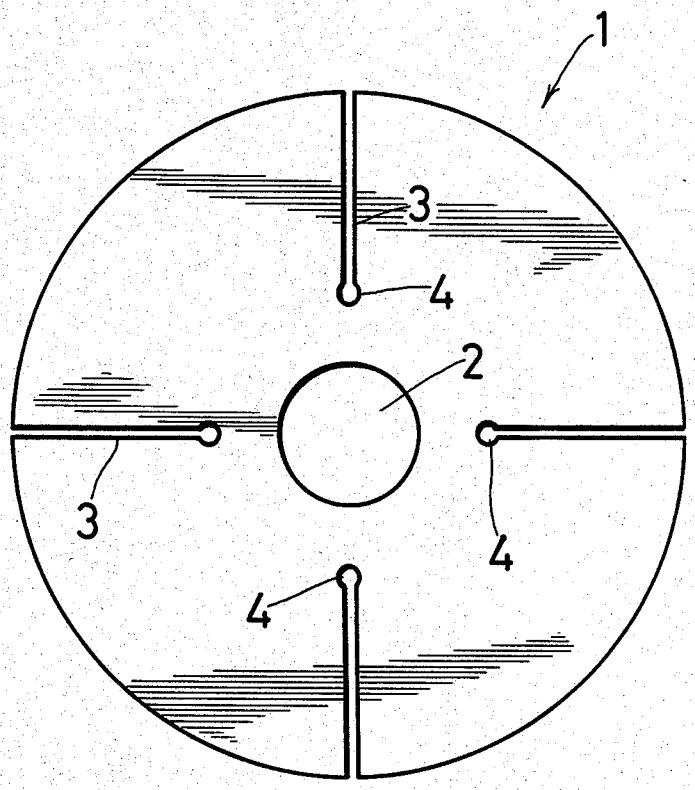
1
3
4
2
3
4
4

SWIMMING POOL CLEANER COMPONENT

BACKGROUND TO THE INVENTION

This invention relates to swimming pool cleaner components and more particularly to the flexible discs which are used on some pool cleaners to hold the unit in contact with the surface to be cleaned and to move dirt to be removed from that surface.

Some types of automatic swimming pool cleaners use a flexible disc around the inlet to the cleaner body. The disc acts as a pressure pad when water is drawn through the cleaner and from beneath the disc. The water above the disc then acts thereon to hold the disc and consequently the pool cleaner body against the surface to be cleaned.

These swimming pool cleaners are well known for their ability to clean both vertical and horizontal surfaces and to move from horizontal to vertical surfaces provided these surfaces meet in a smooth curve of substantial radius. The cleaners per se form no part of this invention which relates only to the discs forming part thereof. Cleaners using this type of disc are disclosed in U.S. Pat. Nos. 4,023,227 and 4,208,752 for example. Such a curve is provided during manufacture when the pool is made by the process known as "guniting". This process utilises the pressure spraying of cementitious material onto a prepared surface such that obtained where the hole for a swimming pool is dug into the ground.

SUMMARY OF THE INVENTION

It is the object of the present invention to provide a disc for such pool cleaners where the difficulty of traversing relatively small radius transitions between horizontal and vertical surfaces without loss of vacuum is avoided to a substantial degree.

According to this invention there is provided a disc for swimming pool cleaners of the type referred to comprising a circular sheet of flexible suitable plastics material centrally perforated to receive the pool cleaner body and characterised in that the disc is divided along a plurality of radially extending lines from the edge across the major portion of the width to the central opening.

A further feature of this invention provides for the disc to be divided into three or four segments and for the divisions to terminate in circular holes.

BRIEF DESCRIPTION OF THE DRAWING

A preferred embodiment of the invention is described below with reference to the accompanying drawing which shows a plan view of a disc according to this invention.

DETAILED DESCRIPTION

As illustrated the disc 1 for a swimming pool cleaner is made to the well known size and from suitable flexible plastics material. The disc 1 has a central perforation 2 which is adapted to engage the body of the cleaner around the inlet mouth. These sizes are well known for the commercial embodiments of the swimming pool cleaners described in the patents above referred to through the wide use and advertising of these cleaners.

The disc 1 has four divisions 3 extending from the outer edge along radially directed lines equidistantly spaced around the disc.

The divisions 3 extend about two thirds of the distance from the edge of the disc to the central opening 2 and terminate in circular holes 4 which have the effect of preventing the divisions tearing further along the radial lines towards the centre of the disc during operation of the cleaner.

The discs are made in conventional manner from suitable plastics material such as polyurethane for example. Other suitable wear resistant material may be used.

In use the pool cleaner operates in the usual manner but as it approaches a vertical surface that segment of the disc which first contacts this surface can more easily lift from the horizontal surface than if it were integral with the rest of the disc 1. Thus the segment can allow the cleaner to traverse a small radius of curvature between the horizontal and vertical surfaces.

The first segment to contact the vertical surface moves up that surface where it operates to hold the cleaner on that surface and allows the cleaner to tilt to take up the appropriate attitude to traverse the vertical surface.

It has been found that the disc according to this invention enables pool cleaners of the type referred to to be used satisfactorily in certain pools which have smooth plastics material linings. This has not heretofore been achieved with any degree of success.

What I claim as new and desire to secure by Letters Patent is:

1. In a swimming pool cleaner of the vacuum suction type having a body and a suction inlet, pressure pad means for enabling the cleaner to traverse relatively small radius transitions between horizontal and vertical surfaces without significant loss of vacuum, said pressure pad means comprising a circular disc (1) of flexible plastics sheet material, a central opening (2) defined in said disc for engaging around the suction inlet of the cleaner body, and a plurality of equally circumferentially spaced radial slots (3) having parallel sides and extending from an outer peripheral edge of the disc across a major portion of the radius thereof toward the central opening, said slots dividing the disc into an equal plurality of independently flexible segments capable of following pool wall transitions and curvatures.

2. A disc as claimed in claim 1 in which the slots divide the disc into at least three segments.

3. A disc as claimed in claim 1 in which the slots terminate in circular holes (4).

4. A disc as claimed in claim 2 in which the slots terminate in circular holes (4).

* * * * *